US005356242A

United States Patent [19]

Elmore et al.

[11] Patent Number: 5,356,242

[45] Date of Patent: Oct. 18, 1994

[54] SYSTEM AND METHOD FOR ADJUSTABLY CONNECTING WALL FACING PANELS TO THE SOLDIER BEAMS OF A TIE-BACK OR ANCHORED WALL

[75] Inventors: J. Thomas Elmore; Alan Veatch, both of Washington, D.C.; William C. Clements, Reston, Va.; Victor Elias, Bethesda; Longine J. Wojciechowski, Gaithersburg, both of Md.

[73] Assignee: JTE, Inc., Lorton, Va.

[21] Appl. No.: 958,260

[22] Filed: Oct. 9, 1992

[51] Int. Cl.[5] ..... E02D 29/02

[52] U.S. Cl. ..... 405/262; 405/285; 405/287

[58] Field of Search ..... 405/262, 275, 284, 285, 405/286, 287, 287.1, 272, 258

[56] References Cited

U.S. PATENT DOCUMENTS

| | | | |
|---|---|---|---|
| 4,369,004 | 1/1983 | Weatherby . | |
| 4,391,557 | 7/1983 | Hilfiker et al. | 405/287 |
| 4,470,728 | 9/1984 | Broadbent | 405/286 X |
| 4,653,962 | 3/1987 | McKittrick et al. . | |
| 4,790,690 | 12/1988 | Vidal et al. | 405/262 |
| 4,836,718 | 6/1989 | Deaton . | |
| 4,913,594 | 4/1990 | Sigourney . | |
| 4,952,097 | 8/1990 | Kulchin | 405/284 X |
| 4,961,673 | 10/1990 | Pagano et al. | 405/287 |
| 5,002,436 | 3/1991 | Sigourney . | |
| 5,158,399 | 10/1992 | Flores | 405/262 X |

*Primary Examiner*—David H. Corbin

*Attorney, Agent, or Firm*—Sixbey, Friedman, Leedom & Ferguson

[57] ABSTRACT

A system and method for adjustably connecting precast wall facing panels to the soldier beams of a tie-back or anchor wall is provided, wherein the system comprises an array of panels stacked in rows having mutually adjacent side edge portions which are spaced apart from one of the soldier beams, a connecting column cast-in-place between the beam and the adjacent side edge portions of the panels for structurally interconnecting both of the panels to the beam, and an adjustable array of reinforcing members within the column for interconnecting the adjacent side edge portions of each of the panels with the beam and for reinforcing the resulting column. The depth of the cast-in-place connecting column advantageously accommodates variations in the distances between the beams and panels. In the method of the invention, a first row of wall facing panels is stacked in front of the soldier beams, and a first section of the connecting column is cast therebetween. Thereafter, a second row of panels is stacked on top of the first, and the process repeated until the wall achieves its desired height. Both the system and the method are particularly applicable to tie-back walls employing piles since the cast-in-place connecting column automatically adjusts for misalignments between the piles and the wall facing panels.

17 Claims, 4 Drawing Sheets

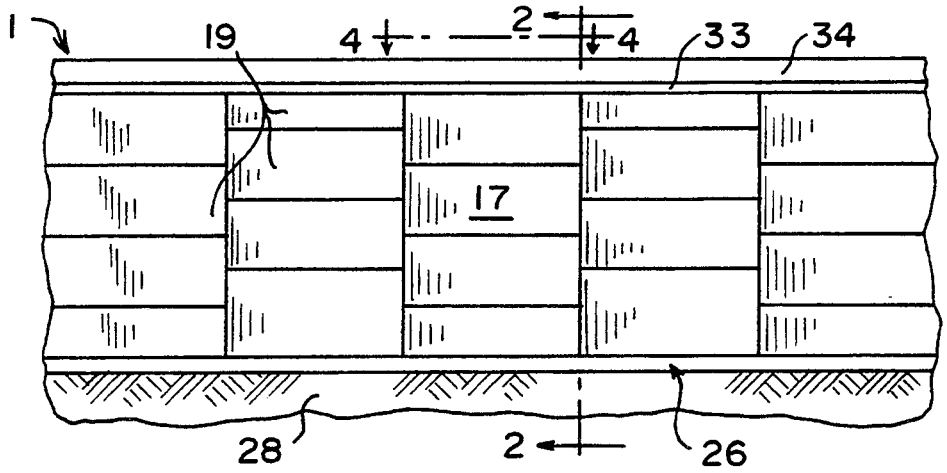
FIG. 1
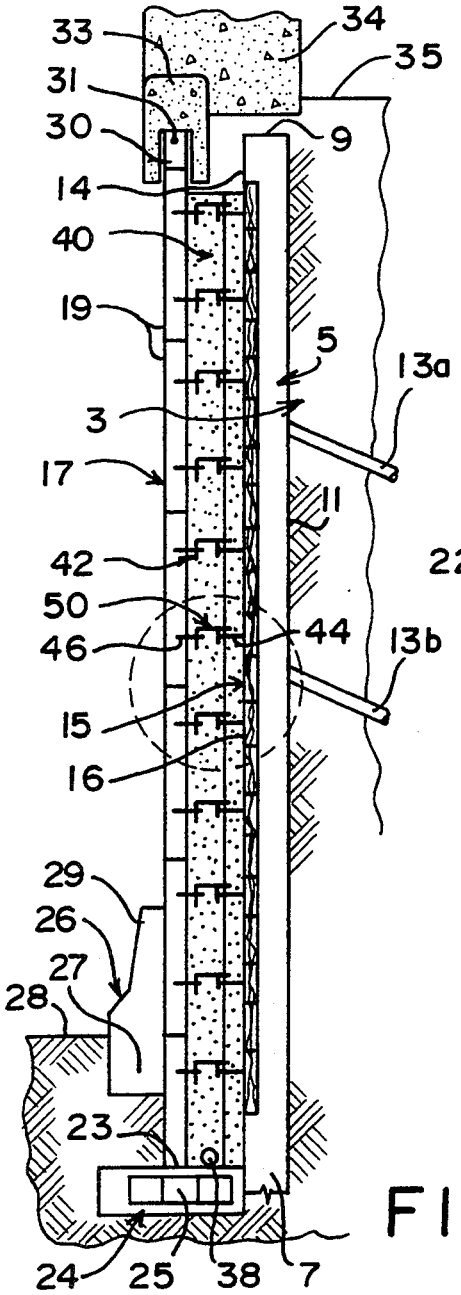
FIG. 2
FIG. 3
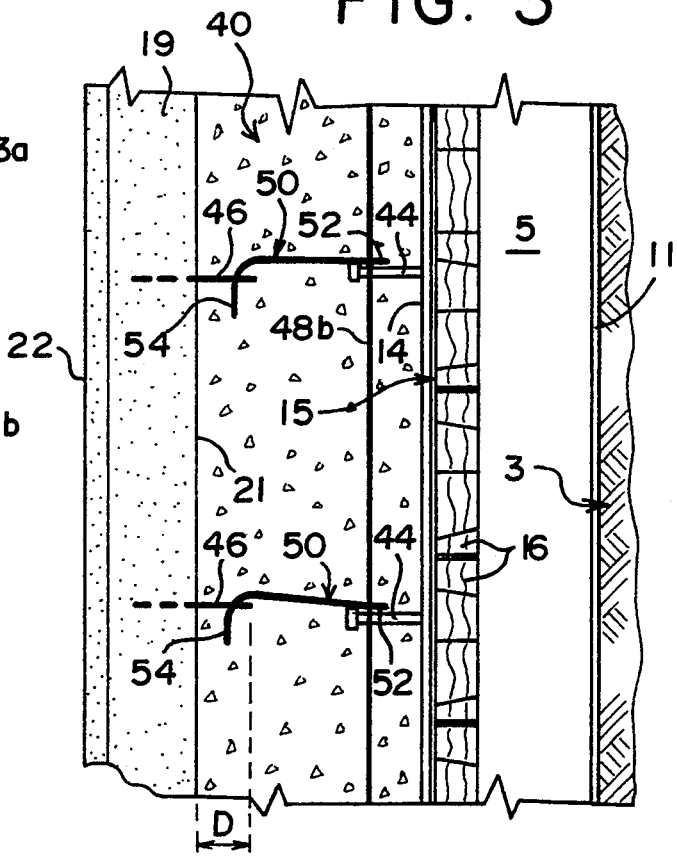

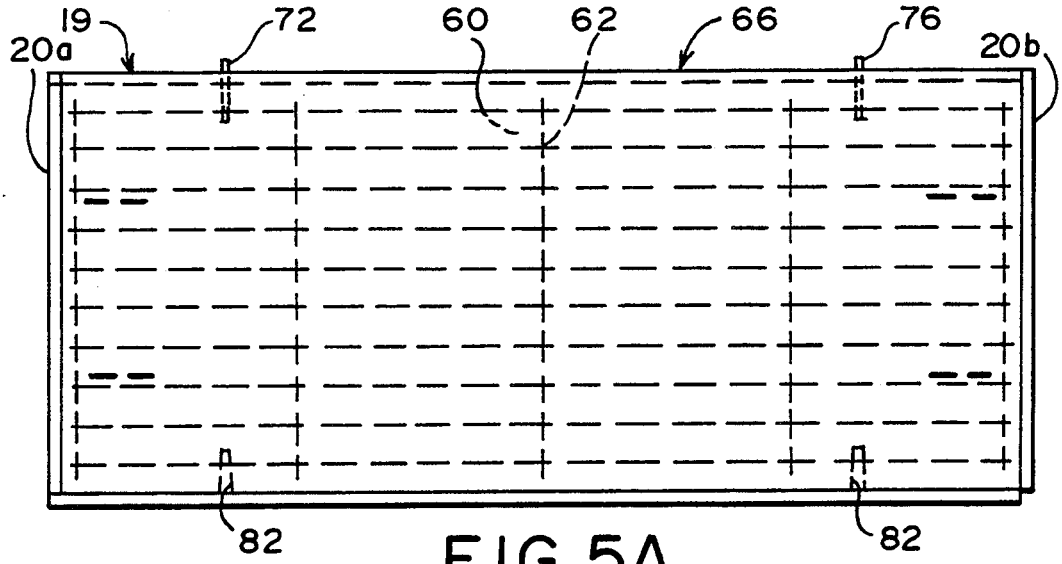
FIG. 5A
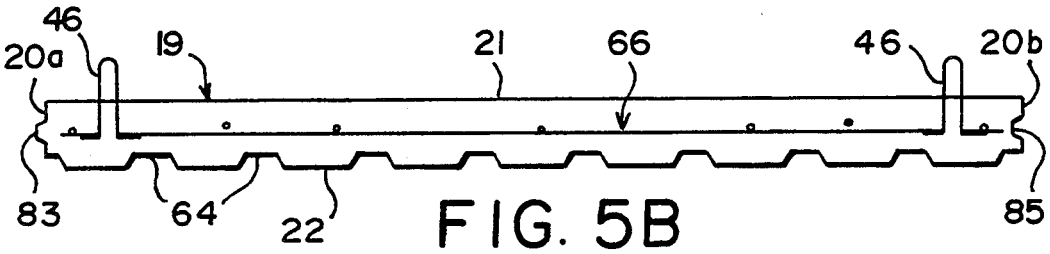
FIG. 5B
FIG. 5C
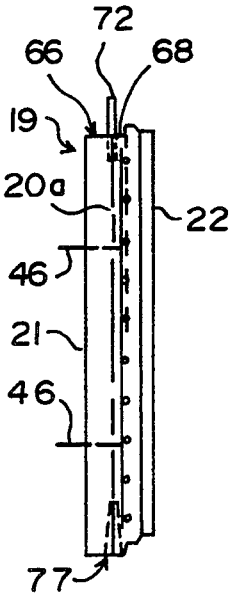
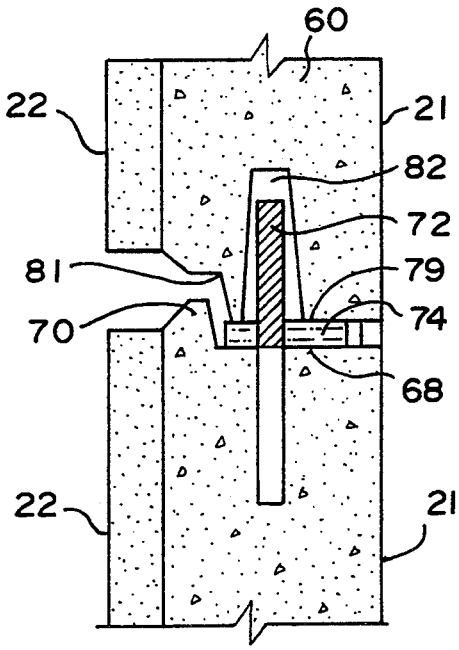
FIG. 6
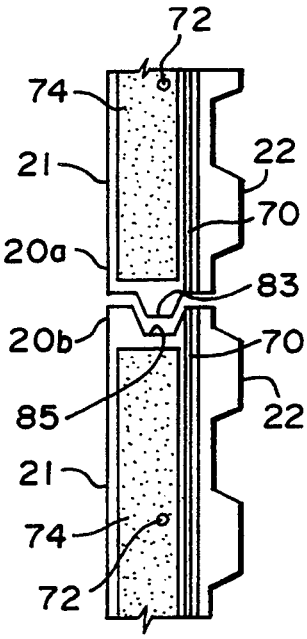
FIG. 7

SYSTEM AND METHOD FOR ADJUSTABLY CONNECTING WALL FACING PANELS TO THE SOLDIER BEAMS OF A TIE-BACK OR ANCHORED WALL

BACKGROUND OF THE INVENTION

This invention generally relates to tie-back or anchored walls, and is specifically concerned with a system and method for adjustably interconnecting the wall facing panels of a tie-back wall to the soldier beams of such a wall despite variations in the distances between the panels and the beams caused by normal misalignments or tolerances of the beams.

Tie-back walls are commonly used as both temporary and permanent earth retaining structures. Typically, such walls are built by first installing a row of uniformly-spaced soldier beams in the earth to be retained. The soldier beams may either take the form of concrete caissons, H-piles, I-beams, channels or the like. When the soldier beams are formed from concrete caissons, a hole is first augured in the earth, a reinforcing structure of steel is then laid in the hole, and the caisson is then cast from concrete. When H-piles or I-beams are used as the soldier beams, they are typically driven into the ground with suitable heavy equipment. For reasons which will become evident shortly, it is important that in either case, the soldier beams be both uniformly spaced from one another, and further be oriented plumb with respect to the earth. After the soldier beams have been installed, the earth is excavated along one side of the beams to expose a cut face of earth, and to partially expose the front faces of the beams. The soldier beams are then securely anchored to the mass of earth behind them by means of a plurality of tie-backs which are installed in the earthen mass and connected to the soldier beams. Lagging in the form of sprayed shotcrete or lagging timber is then installed to temporarily retain the cut face of earth vertically in place. A leveling pad may next be installed in front of the front faces of the beams, and pre-cast wall facing panels may then be stacked in rows to form the finished face of the wall. To complete the wall, the back faces of the wall facing panels are structurally connected to the front faces of the soldier beams, and the gap between the soldier beams and the stack of wall facing panels may be filled either with concrete, or with a water draining, granular material such as gravel.

While such tie-back walls have proven to be an economical and effective means for retaining a bank of earth, problems are created when the row of soldier beams are either not properly aligned with respect to one another or are not plumb with respect to the ground. Such misalignments cause the distances to vary between the front faces of the soldier beams and the back faces of the wall facing panels. This problem is particularly acute when driven piles are used as the soldier beams, since large rocks or other obstructions in the ground can deflect a pile away from a plumb orientation as it is being driven into the earth. If the connecting system used to structurally connect the back of the wall facing panels with the fronts of the soldier beams does not compensate for the variations in the distances between these two components, the misalignment of the beams can become transmitted to the panels after the panels are connected to the beams, thereby seriously compromising not only the esthetics of the resulting wall, but its ability to perform its intended earth-retaining function as well.

Systems for adjustably interconnecting pre-cast wall facing panels to the soldier beams of a tie-back wall are known in the prior art. In some of these systems, adjustable coupling members in the form of brackets or elongated, threaded bolts structurally interconnect the wall facing panels to either pile type or caisson type soldier beams. The space between the wall facing panels and the beams is then backfilled with gravel or the like. Such connection systems are disclosed in U.S. Pat. Nos. 4,913,594 and 5,002,436.

Unfortunately, the applicants have observed a number of shortcomings associated with such prior art adjustable connection systems. For example, in the system disclosed in U.S. Pat. No. 4,913,594, special bracket components must be mounted onto the front faces of the flanges of the H-piles in general alignment with an opposing bracket component mounted on the back side of the wall facing panel. While some flexibility is obtained through the use of vertically and horizontally oriented slots in the connecting components, this connecting system cannot effectively couple the beams to the panels if there are any significant misalignments between the bracketing components. Because this system relies upon a plurality of hand-installed and hand-adjusted nuts and bolts for its assembly and adjustment, it requires a relatively large amount of access and space between the panels and the beams. Additionally, the machined bracket components are relatively expensive to fabricate, and time-consuming to install. While the system disclosed in U.S. Pat. No. 5,002,436 is somewhat different in structure, it suffers from the same basic shortcomings as the system disclosed in U.S. Pat. No. 4,913,594 in that it requires the fabrication of a number of relatively expensively machined threaded components which must be time-consumingly installed and adjusted in the field by hand. Finally, the coupling components used in both of these prior art systems are prone to rust or corrode since they are exposed to ambient air, soil and water, which compromises their suitability for use in a permanent structure.

Clearly, there is a need for an adjustable connecting system which does not require the use of precision-machined, threaded parts and which is quick and easy to install in the field. Ideally, such a system should be inexpensive in its use of materials, and should further be able to accommodate substantial variations in the distances between the soldier beams and the back faces of the panels caused from soldier beam misalignment. Finally, such a system should facilitate the rapid construction of the tie-back wall, and should further result in a wall which utilizes a large amount of relatively inexpensive pre-cast components and which is structurally stronger than prior art walls and which has excellent drainage characteristics and a high degree of corrosion-resistance in all of its reinforcing members.

SUMMARY OF THE INVENTION

Generally speaking, the invention is both a system and a method for adjustably connecting pre-cast wall facing panels to the soldier beams of a tie-back wall that obviates or at least ameliorates the aforementioned shortcomings associated with the prior art. The system of the invention comprises at least two pre-cast wall facing panels having mutually adjacent side edge portions spaced apart from one of the soldier beams, a connecting column cast-in-place between the beam and both of the adjacent side edge portions of the panels for structurally interconnecting both of the panels to the beam, wherein the depth of the column accommodates variations in the distances between the beams and panels caused by misalignments of the soldier beams, an array of adjustable reinforcing members within the column for interconnecting the adjacent side edge portions of each of the panels with the soldier beam, and a footing foundation for supporting the weight of the columns the wall facing panels, and the vertical loads from other appurtenant structures such as crash barriers or the like. The simultaneous interconnection of two side edge portions of two adjacent panels to the same soldier beam results in a more stable tie-back wall and minimizes the need for reinforcing materials in the precast panels.

The array of reinforcing members within the column is adjustable along its depth prior to the casting in place of the column around them in order to accommodate variations in the distances between the beams and the panels. In the preferred embodiment, both the front face of the soldier beams and the back faces of the side edge portions of the adjacent wall panels include anchor members which form part of the array of reinforcing members disposed within the column after the column is cast. The adjustability of the array of reinforcing members is implemented by a stirrup bar having a U-shaped portion, and a pair of bent leg portions. The outside of the U-portion of the stirrup bar is connected to the anchor members projecting from the front face of the soldier beam, while the inside of this U-portion surrounds at least one vertically oriented reinforcing bar. The leg portions of the stirrup bar are linked with the anchor members projecting from the back faces of the wall panels, which in the preferred embodiment are U-shaped lugs formed from reinforcing steel. It is the freedom of movement or slack that the bent legs of the stirrup bar have within the U-shaped lugs projecting from the back faces of the wall panels that affords the depth-adjustability of the resulting array of reinforcing members within the cast-in-place column.

The footing foundation of the system is capable of supporting not only the wall facing panels of the tie-back wall, but the weight of the cast-in-place columns and other appurtenant structures overlying the wall facing panels as well, which combination of components applies an eccentric load to the ground immediately in front of the soldier beams. Such support prevents the application of excessive shear or eccentric stresses on the resulting cast-in-place columns.

The system may be applied to an anchor wall which retains the cut face of an excavation, and the space between the wall facing panels and the cut face and adjacent cast-in-place connecting columns is preferably filled with a water draining, particulate material such as gravel. Additionally, a draining conduit may be disposed between the footing foundation and the particulate material in order to facilitate drainage from the wall. Finally, the system may include wooden lagging for temporarily supporting the cut face of the excavation prior to the casting in place of the connecting columns.

The cast-in-place column of the system advantageously accommodates variations in the distances between the soldier beams and the adjacent side edges of the panels caused from misalignments of the soldier beams. The system is particularly applicable in tie-back walls utilizing piles such as H-piles or I-beams as soldier beams, since such piles are more likely to become misaligned as they are driven into the earth due to the random distribution of large stones in the ground. Additionally, the casting of a cementitious material around the array of reinforcing members (which are typically made of a corrodible metal, such as steel) insulates these corrodible members from ambient air, soil, and water, thereby protracting their lifetimes.

In the method of the invention, the wall facing panels preferably include mutually interfitting joints along not only their side edge portions, but their top and bottom edge portions as well. After the soldier beams have been secured into the ground and an excavation made to expose their front faces and the lagging installed, the previously referred to footing foundation is laid. In the next step of the method, a first row of wall facing panels is laid along the footing foundation in an interfitting, side-to-side relationship with their bottom edges abutting the footing. Next, the previously described array of reinforcing members is positioned between the side edge portions of the panels in the front face of the opposing soldier beam. Side forms are then positioned on either side of the reinforcing array, and a cementitious material is cast in the mold defined between the side forms, and the front face of the soldier beam and the back faces of the two adjacent side edge portions of the panels to form a section of a connecting column. The bottom edges of a second row of wall facing panels are stacked over the top edges of the first row, and the process is repeated until the wall achieves the desired height. Water draining, granular filler material is poured in the spaces between adjacent column sections as the columns are erected.

BRIEF DESCRIPTION OF THE DRAWINGS

FIG. 1 is a front view of a tie-back or anchored wall built in conformance with the connecting system and method of the invention;

FIG. 2 is a side view of the tie-back wall of FIG. 1 along the line 2—2, illustrating a cross-sectional side view of the cast-in-place connecting column of the system of the invention;

FIG. 3 is an enlargement of the area enclosed in FIG. 2 by the dotted circle;

FIGS. 5A, 5Bb, and 5C are a front, plan and side view of one of the precast panels used in the facing wall of the tie-back wall;

FIG. 6 is an enlarged, cross-sectional side view of two stacked precast panels of the type illustrated in FIG. 5A, 5B, and 5C, demonstrating how the alignment pins and conical openings on the upper edge of the bottom panel and the lower edge of the top panel fit together to align and secure the two panels;

FIG. 7 is a plan view of two panels in a side-to-side relationship, wherein a tongue on one side edge portion of one panel is received within a groove on the side edge portion of another panel.

DETAILED DESCRIPTION OF THE PREFERRED EMBODIMENT

Figure 8A:
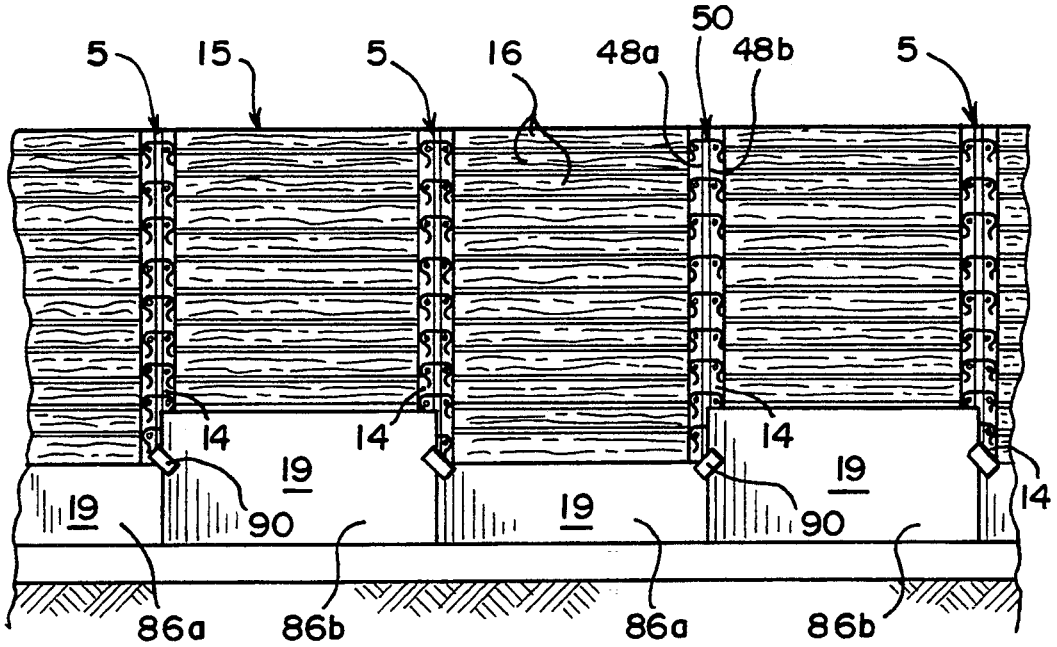
FIGS. 8A and 8B are front views of a tie-back wall being assembled in conformance with both the system and the method of the invention.

With reference now to FIGS. 1, 2, and 8A, the connecting system and method of the invention is particularly adapted for use in a tie-back wall 1 of the type that retains the cut face 3 of an excavation in the earth. Such walls 1 are formed front a row of soldier beams 5 which may be I-beam type piles which are first driven into the earth such that their bottom ends 7 are sunk well below the floor level of the excavation to be made, while their top ends 9 define the height of the wall 1 to be built. An excavation is then made to form the cut face 3, which partially exposes the soldier beams 5. Next, the back face or flange 11 of the beams 5 are secured to tie-backs 13 (only partially shown) which are anchored deep in the ground opposite the front face of the wall 1. Lagging 15 is then constructed between the front face or flange 14 and the back face or flange 11 of the beams 5 in order to retain the earth forming the cut face 3 while the construction of the tie-back wall 1 is completed. As is best seen in FIGS. 4 and 8A, lagging 15 is formed from lagging timber 16 which is slid behind the front flanges 14 of adjacent beams 5.

The tie-back wall 1 further includes a facing wall 17 spaced apart from the row of beams 5 which is formed from a plurality of pre-cast facing panels 19 stacked as shown in FIG. 1. Each of the pre-cast facing panels 19 includes a pair of opposing side edge portions 20*a*, 20*b*, as well as a back face 21 and a front face 22. Facing wall 17 has a bottom edge 23 which overlies a footing foundation 24. The function of the footing foundation 24 is not merely to create a level support surface for the bottom edge 23 of the facing wall 17, but to completely support the entire weight of not only the facing wall 17, but the traffic barrier 34, the cast-in-place connecting columns 40 and the water-conducting, granular filler 37 disposed between the facing wall 17 and lagging 15. The footing foundation 24 is constructed from a row of rectangular foundation pedestals 25 which are formed from steel reinforced concrete. In the event that the tie back wall 1 borders an automobile right-of-way, a row of traffic barriers 26 may be placed on the lower outside face of the facing wall 17 as shown in order to protect the lower-most, pre-cast facing panels 19 from being directly struck by an automobile. If such traffic barriers 26 are included as part of the tie-back wall 1, the base portion 27 of the barriers 26 is buried below the ground level 28 as shown so that only the upper portions 29 overlap the lowermost, exposed portion of the facing wall 17. Such construction helps to secure the traffic barriers 26 in their protective position with respect to the lowermost panels of the facing wall 17. The facing wall 17 further includes a top edge 30 over which a layer of leveling concrete 31 and a plurality of pre-cast copings 33 are placed. Traffic barriers 34 are in turn placed over and supported by the copings 33 when the wall 1 borders an automobile fight-of-way. The leveling concrete 31 secures the pre-cast copings 33 over the top edge 30 of the facing wall 17 in order to maintain the upper edges of the top panels 19 in alignment, as well as to generally reinforce the overall strength of the facing wall 17. A layer of grading or pavement 35 overlies the top ends 9 of the beams 5 and fills in the space between the back face of the copings 33, the bottom of the traffic barriers 34 and the embankment formed by the cut face 3.

Figure 4:
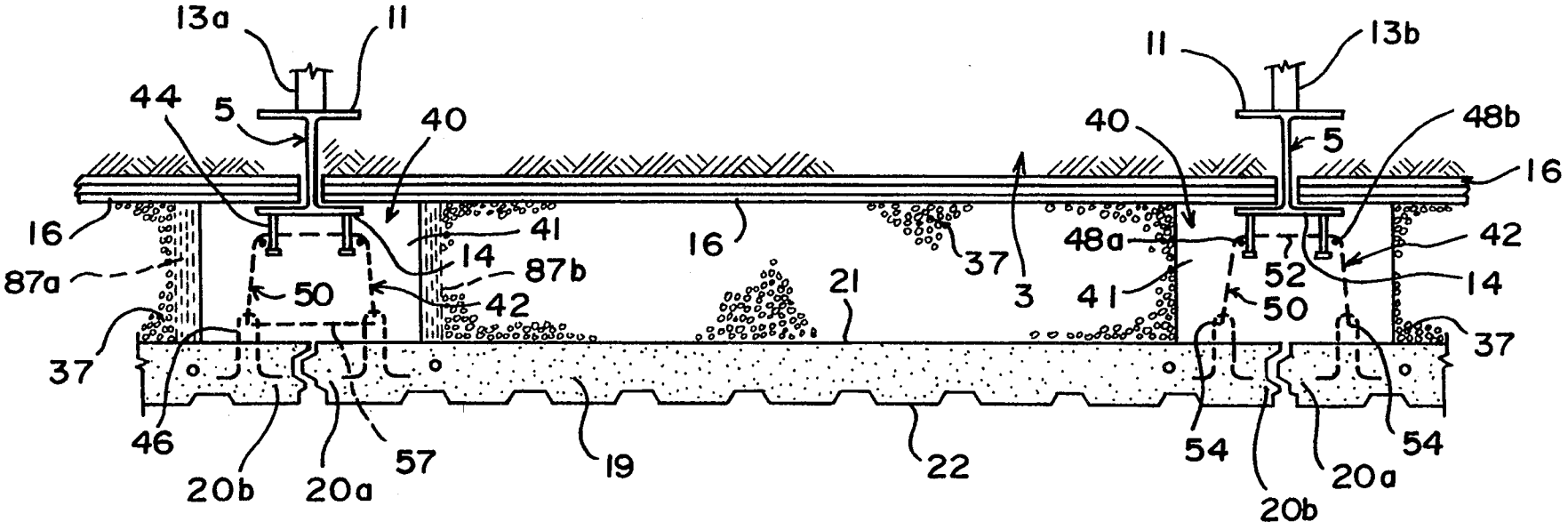
FIG. 4 is a plan view of the tie-back wall illustrated in FIG. 1 with the coping, traffic barriers, leveling concrete and upper surface of grading removed.

With reference now to FIG. 4, most of the space between the facing wall 17 and the lag wall 15 is filled in with a water-conducting, granular filler 37 such as gravel or crushed rock. Such granular filler 37 helps to structurally integrate the facing wall 17 with the cut face 3, while at the same time providing an ample amount of water drainage in this area. To insure that water will not collect between the facing wall 17 and the cut face 3, a drainage conduit 38 is provided in the position shown on top of the footing foundation 24.

With reference now to FIGS. 2, 3, and 4, the connecting system of the invention generally comprises a cast-in-place connecting column 40 for structurally interconnecting the front faces 14 of the beams 5 with the side edge portions 20*a*, 20*b* of the panels 19 that make up the facing wall 17. Each of the cast-in-place connecting columns 40 is formed from a cementitious material 41 such as concrete which is cast over an array of reinforcing members 42. As will be seen in more detail hereinafter, because the connecting columns 40 are cast-in-place, variations in the distances between the front faces 14 of the beams 5 and the back faces 21 of the precast facing panels 19 are automatically accommodated by the liquidity of the cementitious material that hardens to form the resulting column 40 to create a column 40 whose depth is exactly equally to the distance between the front face 14 of the beams 5 and the back face 21 of the panels 19.

The array 42 of reinforcing members that forms the skeleton of the cast-in-place columns 40 is formed in part from a plurality of studs 44 which protrude off of the front face 14 of the beams 5. These studs are arranged in horizontally opposing pairs on the front faces 14 of the beams 5, which pairs are vertically spaced apart along the lengths of the beams 5. Further included within the array 42 are U-shaped lugs 46 which project from the back faces 21 of the panels 19. A third element of the array 42 is a pair of vertically oriented reinforcing bars 48*a*, 48*b* which are parallel with respect to one another and disposed along the outer sides of the opposing pairs of studs 44 projecting from the beams 5. Linking together the studs 44, the U-shaped panel lugs 46 and the vertical reinforcing bars 48 are a plurality of stirrup bars 50 whose structure is best seen in FIGS. 3, 4, and 8A. Each of the stirrup bars 50 includes a U-shaped portion 52 at one end which hangs over a pair of opposing studs 44 which project from the front face of the beams 5 as shown. Each of these stirrup bars 50 further includes a pair of opposing legs 54 at its other end which are received within one of the U-shaped panel lugs 46 from different side-to-side panels 19, as can best be seen in FIGS. 3 and 4. Because the opposing legs 54 of the stirrups 50 can be inserted anywhere within U-shaped panel lugs 46 and still effectively link these lugs 46 with the studs 44 and vertical reinforcing bars 48A, 48B, the resulting array 42 of reinforcing member is adjustable in the depth-wise direction for the distance D as shown in FIG. 3. Such depth-wise adjustability of the array 42 allows the array 42 to effectively reinforce the surrounding cementitious material 41 that forms the connecting column 40 over a relatively large depth-wise distance, thus helping to create a connecting column structure which can accommodate broad variations in the distance between the front face 14 of the beams 5 and the back face 21 of the precast facing panels 19 without any compromises in structural strength. Of course, for heavier structures, a pair stirrup bars 50 could be used having mutually opposing U-shaped sections 52 and mutually overlapping legs 54. Alternatively, a cross member 57 may be tied between the legs 54 after the legs have been dropped into the lugs 46 of the opposing panels 19, as shown in FIG. 4. Finally, square stirrups of different sizes could be used to accommodate different column depths. In the preferred embodiment, the studs, the lugs 46, the vertical reinforcing bars 48*a*, 48*b*, and the stirrup bars 50 may be all formed from epoxy-coated structural steel in order to discourage corrosion in the form of rust on these reinforcing members. Additionally, the cementitious material 41 which surrounds each of the members of the array 42 of reinforcing members assists in preventing undesirable corrosion from occurring by insulating each of these reinforcing members from ambient air, soil, and water.

With reference now to FIGS. 5A, 5B, and 5C, the precast facing panels 19 that form the facing wall 17 are, like the columns 40, formed from a cementitious material 60 cast around a grid 62 of reinforcing members formed from structural steel. The front face 22 of each of the panels 19 may include an architectural finish such as the decorative flutes 64 shown, while the back face 21 may be screeded. To aid in the construction of the tie-back wall 1, each of the edges of the facing panels 19 includes a means for interlocking with the edge of an adjacent panel 19. For example, with reference now to FIGS. 5B, 5C, and 6, the top edge 66 of each of the panels 19 includes a recessed top wall 68 bordered by a linear lip 70. A pair of alignment pins 72 (which are preferably formed from plastic dowels) extend from the recessed top wall 68 of the top edge 66 of each of the panels 19. As is seen in FIGS. 6 and 7, a bearing pad 74 formed from a strip of plastic foam overlies the recessed top wall 68 and surrounds each of the two alignment pins 72 for a purpose which will become evident shortly. With reference again to FIGS. 5B, 5C and 6, the bottom edge 77 of each of the facing panels 19 includes a protruding bottom wall 79 bordered by a linear recess 81 which is generally complementary in shape to the lip 70 disposed on the top edge 66 of each of the panels 19. Additionally, the bottom edge 77 of each of the panels 19 includes a pair of conical openings 82 which are spaced apart the same distance as the alignment pins 72 for receiving these pins when one panel is stacked on top of another panel, as is shown in FIG. 6. The placement of the conical openings 82 on the bottom edges of the panels 19 prevents them from collecting water. The receipt of the alignment pins 72 within the conical openings 82 not only properly aligns the panels 19 as they are stacked so that their opposing side edge portions 20*a*, 20*b* are in alignment, but further helps to secure the panels 19 in such a stacked relationship which in turn facilitates the erection of the facing wall 17 during the construction of the tie-back wall 1. The provision of the resilient bearing pad 74 creates an air and light tight seal between adjacent edges of stacked panels 19, and further helps to prevent any cracking from occurring when the panels 19 are stacked on top of one another by absorbing some of the shock when an upper panel is lowered on top of a lower panel. As shown in FIGS. 4 and 7, one of the side edge portions 20*a* of each panel 19 includes a tongue 83, while the other side edge portion 20*b* includes a complementarily-shaped groove 85. The provision of a tongue 83 and groove 85 on opposing sides of each of the panels 19 provides still another stabilizing interlock between adjacent panels 19 which helps to hold the facing wall 17 together when the columns 40 are poured.

Figure 8B:
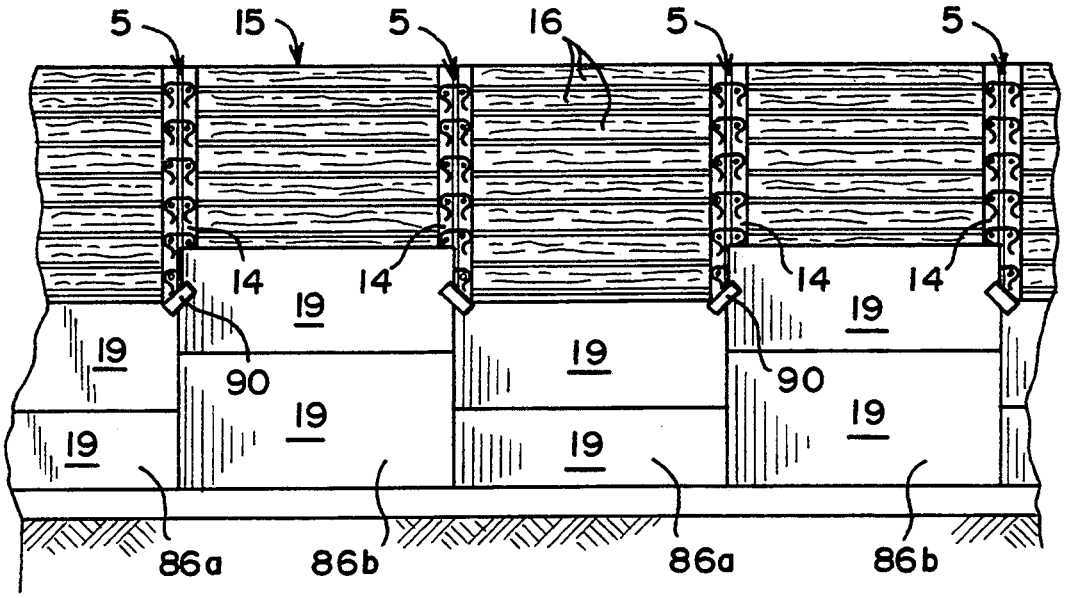

FIGS. 8A and 8B illustrate the connecting method of the invention which takes place after the beams 5 have been driven in the earth, the cut face 3 excavated, the tie-backs 13*a*, 13*b* installed, and the lagging 15 built. In the first step of this method, the previously described footing foundation 24 is cast and installed in the position illustrated in FIG. 2. Next, the studs 44 of the reinforcing array 42 are welded on the front face 14 of the beams 5 in opposing pairs as is shown in FIG. 8A and 8B. After all of the studs 44 have been installed, the vertical reinforcing bars 48*a*, 48*b* are secured onto their respective column of studs by wire twists of the type commonly used to mount reinforcing steel prior to a casting operation. In the next step of the method of the invention, the U-shaped portion 52 of a stirrup bar 50 is hung over every one of the opposing pairs of studs 44 as shown, with the two parallel reinforcing bars 48*a*, 48*b* contained within the U-shaped portion 52 such that the stirrup bar 50 will not easily fall off from the pair of opposing studs 44 from which they hang. The next step of the method may best be seen with reference to FIG. 4 and 8A. In this step, a bottom row of precast facing panels 19 is laid on top of the footing foundation 24 in spaced apart relationship with respect to the front faces 14 of the beams 5. This first bottom row of panels 19 is formed alternately from half-size panels 86*a* and full-size panels 86*b* in an imbricated pattern to better support the second row of panels that will be stacked over it. These panels are laid out in a straight row, with their opposing side edge portions 20*a*, 20*b* closely adjacent to one another such that the tongues 83 on one side of each of the panels 19 is closely received within the groove 85 present in the side of the adjacent panel 19. The tongue and groove relationship between adjacent panels 19 causes each of the panels 19 to be strongly supported against falling over by the two panels on either side of it.

In the next step of the method of the invention, the opposing lugs 54 of the stirrup bars 50 are dropped into the lugs 54 of the two adjacent panels 19 opposing the front face 14 of the beam 5. Side forms 87*a*, 87*b* (indicated in phantom in FIG. 4) are then installed between the side edge portions 20*a*, 20*b* of the two adjacent panels 19. The side edges of adjacent panels 19 are further interconnected by means of detachably securable clamps 90, such that a concrete mold is defined between the two side forms 87*a*, 87*b* the front face 14 of the beams 5, and the back faces of the opposing side edge portions 20*a*, 20*b* of the adjacent panels 19. At this juncture, a first section of the cast-in-place column 40 is formed by pouring a hardenable, cementitious material 41 such as concrete into the previously described mold. This first section of the cast-in-place connecting column 40 is then allowed to harden. After the material 41 hardens, the side forms 87*a*, 87*b* are removed and the previously described water-conducting, granular filler 37 is poured in between the newly made column sections.

FIG. 8B generally illustrates the subsequent step of the method of the invention. In these steps, the bearing pads 74 are laid over the top edges of the panels 19. Next a second row of panels 19 is stacked on top of the bottom row in the positions illustrated. In addition to the previously described, interfitting tongues and grooves on the side edge portions 20*a*, 20*b* of adjacent panels, the bottom edges 77 of each of these panels is further secured to the top edges 66 of the bottom most panels by way of the previously described alignment pins 72, and interfitting lips 70 in linear recesses 81. Additionally, the vertically staggered pattern of the panels 19 forming the first row causes the side edge portions 20*a*, 20*b* of every other panel 19 to interlock with the adjacent side edge portions 20*a*, 20*b* of two panels 19, thereby further contributing to the self-supporting strength of the facing wall 17. The opposing lugs 54 of the stirrup bars 50 are again dropped into the lugs 54 of the panels forming the second row of the facing wall 17, and the side forms 87*a*, 87*b* and clamps 90 are reinstalled in the same manner as previously described. Another section of the column 40 is then poured and allowed to harden. The method is repeated until the desired height of the resulting tie-back wall 1 is obtained, whereupon the previously described leveling concrete 31, coping 33 and grade or pavement 35 is installed over the top edge 30 of the facing wall 17 to complete construction of the tie-back wall 1.

We claim:

1. A system for adjustably connecting pre-cast wall panels having opposing side edge portions and a back side to spaced soldier beams of a tie-back wall that retains the cut face of an excavation, comprising:

at least two of said panels having mutually adjacent side edge portions spaced apart from a front face of one of said soldier beams;

a connecting column means integrally cast-in-place from cementitious material between the front face of said soldier beam and a back side of each of said panels in the area of the adjacent side edge portions of said panels for structurally interconnecting the panels to said soldier beam, said connecting column means being formed to accommodate misalignments between said soldier beams and said panels;

an array of reinforcing members for both structurally interlinking said panels and said soldier beam and reinforcing said column means, said array being adjustable prior to the casting of said column means to accommodate variations in the distances between said soldier beam and panel side edge portions and including first anchoring members mounted on said soldier beam and extending from the front face thereof and second anchoring members mounted on said panels and extending from the back faces thereof in the area of the panel side edge portions, a linking member for interconnecting said first and second anchor members and for adjusting said array prior to casting of said column means, said array also including at least one vertically oriented bar member, said linking member having a portion for receiving said vertically oriented bar member and a portion interlinkable with the anchor members of said panels; and a footing foundation for supporting an eccentric load applied by the column means, the panels and an appurtenant structure.

2. A system as defined in claim 1, wherein said tie-back wall retains the cut face of an excavation, and wherein space between said wall facing panels and said cut face is filled with water draining particulate material.

3. A system as defined in claim 2, further comprising a drainage conduit disposed between said footing foundation and said particulate material disposed between said wall facing panels and said cut face.

4. A system as defined in claim 1, wherein said system further comprises side form means for moldably conforming the cementitious material that forms the column means when said column means is cast.

5. A system as defined in claim 4, wherein said side form means are detachably securable between the panels and the cut face.

6. A method for assembling a fie-back wall out of structural steel beams and pre-cast wall facing panels having opposing side edge portions, comprising the steps of:

driving a row of structural steel beams into the ground in uniformly spaced apart relationship having first anchor members;

excavating a cut face in the earth so as to partially expose said beams;

laying a footing foundation in front of said beams for supporting an eccentric load;

laying at least two panels on said footing foundation in a side to side relationship wherein the mutually adjacent side edge portions are spaced directly apart from the exposed portion of one of said beams said panels having second anchor members projecting from said side edge portions;

linking an adjustable array of reinforcing members between each of said adjacent panel side portions and the exposed portion of said beams by means of linking members movable between said first and second anchor member;

adjusting the array of reinforcing members by moving said linking members to vary the distance between said wall facing panels and said beam to correct for misalignments between the beam and the panel side edge portions, and casting in place over said adjustable array a length of a connecting column between said portion of said beams and said adjacent panel side edge portions to structurally interconnect them.

7. A system for adjustably connecting pre-cast wall panels having opposing side edge portions and a back side to spaced soldier beams of a tie-back wall that retains the cut face of an excavation comprising:

at least two wall panels having mutually adjacent side edge portions spaced from a front face of one of said soldier beams; and an array of reinforcing members for a column of cast cementitious material structurally connecting the opposing side edge portions of said two wall panels to said one of said soldier beams, said array being adjustable prior to the casting of said column to accommodate variations in the distances between said soldier beam and panel side edge portions and including first anchoring means mounted on said soldier beam and extending outwardly therefrom, second anchoring means mounted on said adjacent side edge portions of said panels and extending outwardly from the panel side edge portions thereof, and at least one linking member connecting said first anchoring means to the second anchoring means on the mutually adjacent side edge portions of said two wall panels, said linking member being movable relative to at least one of said first and second anchoring means to permit adjustment of the distance between said two wall panels and said one soldier beam;

a column cast of said cementitious material over said array and between said opposing side edges of said panels and said one soldier beam, and a footing foundation for supporting an eccentric load.

8. A system as defined in claim 7 wherein said single linking member is formed by a stirrup with a U-shaped portion having a pair of spaced legs, each of said legs being linked with said second anchoring means with one of said legs being linked with second anchoring means on one of said two adjacent wall panels and the remaining of said legs being linked with second anchoring means on the second of said two adjacent wall panels.

9. The system of claim 8 wherein said second anchoring means include U-shaped bars projecting from said first and second wall panels, each of said stirrup leg portions terminating in a hoop means for interlinking with one of said U shaped bars.

10. A system as defined in claim 7 which includes a connecting column of cast-in-place cementitious material formed to envelop said array of reinforcing members and extending between the front face of said soldier beam and the back side of each of said panels in the area of the adjacent side edges thereof for structurally interconnecting the panels to said soldier beam, said linking member being movable prior to the casting of said connecting column to vary the distance between the front face of said soldier beam and the back sides of said wall panels.

11. A system as defined in claim 10 wherein said single linking member is formed by a stirrup with a U-shaped portion having a pair of spaced legs, each of said legs being linked with said second anchoring means with one of said legs being linked with second anchoring means on one of said two adjacent wall panels and the remaining of said legs being linked with second anchoring means on the second of said two adjacent wall panels.

12. The system of claim 11 wherein said second anchoring means include U-shaped bars projecting from said first and second wall panels, each of said stirrup leg portions terminating in a hoop means for interlinking with one of said U shaped bars.

13. A system as defined in claim 10 wherein at least one of said two wall panels extends between two of said spaced soldier beams and two of said arrays of reinforcing members are provided to connect said one wall panel to each of said spaced soldier beans, two spaced connecting columns of cast-in-place cementitious material being formed with each column enveloping an array of reinforcing members and extending between the front face of one of said soldier beams and the back side of said one panel.

14. A system as defined by claim 13 wherein particulate material is contained between said connecting columns, the back side of said one panel and the cut face of the excavation to provide water drainage.

15. A system as defined by claim 7 wherein a third wall panel is mounted on top of a first of said two wall panels, each of said wall panels being bordered by a top edge, a bottom edge and first and second spaced side edges extending between the top and bottom edges, the third wall panel being mounted with the bottom edge thereof being supported on the top edge of the first of said two wall panels, said first of said two wall panels having spaced alignment pins projecting outwardly from the top edge thereof and said third wall panel having alignment pin receiving recesses extending inwardly from the bottom edge thereof to receive said alignment pins of said first wall panel.

16. A system as defined by claim 15 wherein a connecting column of cast-in-place cementitious material is formed to extend between said first, second and third wall panels and said solder beam for structurally connecting said wall panels to said soldier beam, said cementitious material enveloping said array of reinforcing members.

17. A system for adjustably connecting pre-cast wall panels having opposing side edge portions and a back side to a soldier beam of a tie-back wall that retains the cut face of an excavation comprising:

at least two wall panels having mutually adjacent side edge portions spaced from a front face of said soldier beam;

an array of reinforcing members for a column of cast cementitious material structurally connecting the opposing side edge portions of said two wall panels to said soldier beam, said array being adjustable prior to the casting of said column to accommodate variations in the distance between said soldier beam and panel side edge portions and including first anchoring means mounted on said soldier beam and extending outwardly therefrom, said first anchoring means including a first hook shaped member projecting outwardly from the front face of said soldier beam and a second hook shaped member spaced from said first hook shaped member and projecting outwardly frown the front face of said soldier beam, and second anchoring means mounted on said panels and extending outwardly from the panel side edge portions thereof, said second anchoring means including loop shaped members for receiving said hook shaped members, said first hook shaped member interlinking with a loop shaped member mounted on one of said two wall panels and said second hook shaped member interlinking with the loop shaped member mounted on the remaining wall panel;

a column cast of said cementitious material over said array and between said panel side edge portions and said soldier beam, and a footing foundation for supporting an eccentric load.

* * * * *